US010550741B2

(12) United States Patent
Rosenberger

(10) Patent No.: US 10,550,741 B2
(45) Date of Patent: Feb. 4, 2020

(54) ENGINE BLOCK AND ENGINE HAVING AN ENGINE BLOCK

(71) Applicant: Bayerische Motoren Werke Aktiengesellschaft, Munich (DE)

(72) Inventor: Maximilian Rosenberger, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/263,126

(22) Filed: Jan. 31, 2019

(65) Prior Publication Data

US 2019/0162087 A1 May 30, 2019

Related U.S. Application Data

(63) Continuation of application No. PCT/EP2017/068183, filed on Jul. 19, 2017.

(30) Foreign Application Priority Data

Aug. 4, 2016 (DE) ..... 10 2016 214 402

(51) Int. Cl.
*F01M 1/10* (2006.01)
*F01M 11/04* (2006.01)
*F01M 11/02* (2006.01)

(52) U.S. Cl.
CPC ..... *F01M 1/10* (2013.01); *F01M 11/02* (2013.01); *F01M 11/04* (2013.01); *F01M 2001/1064* (2013.01); *F01M 2011/023* (2013.01)

(58) Field of Classification Search
CPC .. F01M 1/10; F01M 1/16; F01M 1/22; F01M 11/02; F01M 11/04; F01M 11/0408;
(Continued)

(56) References Cited

U.S. PATENT DOCUMENTS 3,447,636 A * 6/1969 Bonfilio ..... F01M 11/0458 123/196 R
5,339,776 A * 8/1994 Regueiro ..... F01M 1/16 123/196 AB
(Continued)

FOREIGN PATENT DOCUMENTS

DE 3639122 A1 * 11/1987 ..... B67D 7/36
DE 43 00 262 A1 7/1994
(Continued)

OTHER PUBLICATIONS

International Search Report (PCT/ISA/210) issued in PCT Application No. PCT/EP2017/068183 dated Oct. 23, 2017 with English translation (four (4) pages).
(Continued)

*Primary Examiner* — Hung Q Nguyen
(74) *Attorney, Agent, or Firm* — Crowell & Moring LLP

(57) ABSTRACT

An engine block with an oil path switching arrangement is proposed. The engine block includes an oil sump, an oil pump, a clean oil riser and a switching valve. The switching valve has in each case connections for the oil sump, the oil pump and the clean oil riser. The switching valve is switchable to open and close the connections, including a first position in which a connection between the clean oil riser and the oil sump is established, thereby avoiding discharge of oil in the clean oil riser through an oil filter receptacle during an oil change.

8 Claims, 3 Drawing Sheets

(58) Field of Classification Search
CPC ..... F01M 11/0458; F01M 2011/0425; F01M 2011/0466; F01M 2011/023; F01M 2011/033
See application file for complete search history.

(56) References Cited

U.S. PATENT DOCUMENTS

| | | | | |
|---|---|---|---|---|
| 5,517,959 | A * | 5/1996 | Kato | F01M 1/02 123/196 AB |
| 2003/0213650 | A1 | 11/2003 | Tsujihara | |
| 2005/0072396 | A1 | 4/2005 | Lee | |
| 2009/0194369 | A1 | 8/2009 | Miyazaki et al. | |
| 2014/0261280 | A1* | 9/2014 | Danford | F01M 1/20 123/188.9 |
| 2015/0114337 | A1* | 4/2015 | Marthaler | F01M 11/061 123/196 CP |

FOREIGN PATENT DOCUMENTS

| | | | |
|---|---|---|---|
| DE | 103 13 614 | A1 | 11/2003 |
| DE | 10 2013 011 886 | A1 | 1/2015 |

OTHER PUBLICATIONS

German-language Written Opinion (PCT/ISA/237) issued in PCT Application No. PCT/EP2017/068183 dated Oct. 23, 2017 (four (4) pages).
German-language Search Report issued in counterpart German Application No. 102016214402.2 dated Mar. 17, 2017 with partial English translation (11 pages).

* cited by examiner

ENGINE BLOCK AND ENGINE HAVING AN ENGINE BLOCK

CROSS REFERENCE TO RELATED APPLICATIONS

This application is a continuation of PCT International Application No. PCT/EP2017/068183, filed Jul. 19, 2017, which claims priority under 35 U.S.C. § 119 from German Patent Application No. 10 2016 214 402.2, filed Aug. 4, 2016, the entire disclosures of which are herein expressly incorporated by reference.

BACKGROUND AND SUMMARY OF THE INVENTION

The invention relates to an engine block and to an engine having such an engine block, in particular for vehicles with an internal combustion engine.

Engine blocks as well as internal combustion engines having engine blocks are known. In the case of many engines, use is made of lubricants, i.e. engine oil, in order to lubricate moving parts and to thereby reduce the wearing thereof. To this end, the engine oil is provided via an engine oil circuit to the appropriate locations in the engine. An oil pump sucks up engine oil from an oil pan and pumps the engine oil via a raw oil feed line to an oil filter for processing. From there, the filtered engine oil is distributed via a clean oil riser to the devices which are to be lubricated in the engine.

From time to time, it is necessary to replace consumed engine oil with fresh engine oil in order to retain the advantageous properties of the engine oil. In the case of such an engine oil service, a screw is removed in the base of the oil pan of the engine in order to allow the engine oil located in the oil pan to flow out through said opening.

Some of the engine oil remains within the tubes and ducts of the engine oil circuit, however, in particular in the raw oil feed line and the clean oil riser. In construction terms, this remaining engine oil is located directly above the oil filter housing, this being integrated in the oil pan.

If the oil filter cover on the oil filter housing is opened, the engine oil located above the oil filter housing flows away via the opening which is thereby created, and soils the oil filter cover, the worker and also the relatively close surroundings of the engine block, for example the underbody trim of a vehicle. If the soiled surroundings are not cleaned thoroughly, there is the risk that, for example in the case of the underbody trim, engine oil later drips from the vehicle and is judged to be an oil leakage on the engine.

It is an object of the invention to provide an engine block which allows for improved drainage of engine oil by reducing the instances of soiling by engine oil which arise.

To achieve the object, provision is made of an engine block comprising an oil pan, an oil pump, a clean oil riser and a switching valve, wherein the switching valve comprises a respective port for the oil pan, the oil pump and also the clean oil riser, and has a first position, in which a connection is established between the clean oil riser and the oil pan. The engine oil located in the clean oil riser can be drained into the oil pan via this connection, as a result of which it is then no longer located above the oil filter housing and can run via the oil filter cover if the latter is opened. Furthermore, this short-circuiting of the clean oil riser with the oil pan vents the raw oil feed line, and therefore the engine oil which is present there can flow away more easily and more rapidly into the oil pan.

The switching valve is preferably a 3-way valve, since in this way the switching valve can have the first position, in which a connection is established between the clean oil riser and the oil pan, in addition to further positions.

According to one advantageous embodiment, the switching valve has a second position, in which a connection is established between the clean oil riser and the oil pump, in order to be able to pass on the pressure of the clean oil riser to the oil pump.

According to a further advantageous embodiment, the switching valve has a third position, in which a connection is established between the oil pump and the oil pan, in order to be able to reduce the pressure in the control chamber of the oil pump.

The switching valve preferably has a fourth position, in which the ports of the clean oil riser and of the oil pump are closed, in order to be able to maintain the pressure in the control chamber of the oil pump.

According to the invention, an engine having an engine block according to the invention and a control system is also provided in order to achieve the aforementioned object.

It is advantageous if the control system is designed in such a manner that the switching valve can be switched into the first position only when the engine is stationary. This ensures that said position provided for the engine oil service is not inadvertently used during operation of the engine, and damage to the engine does not occur.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
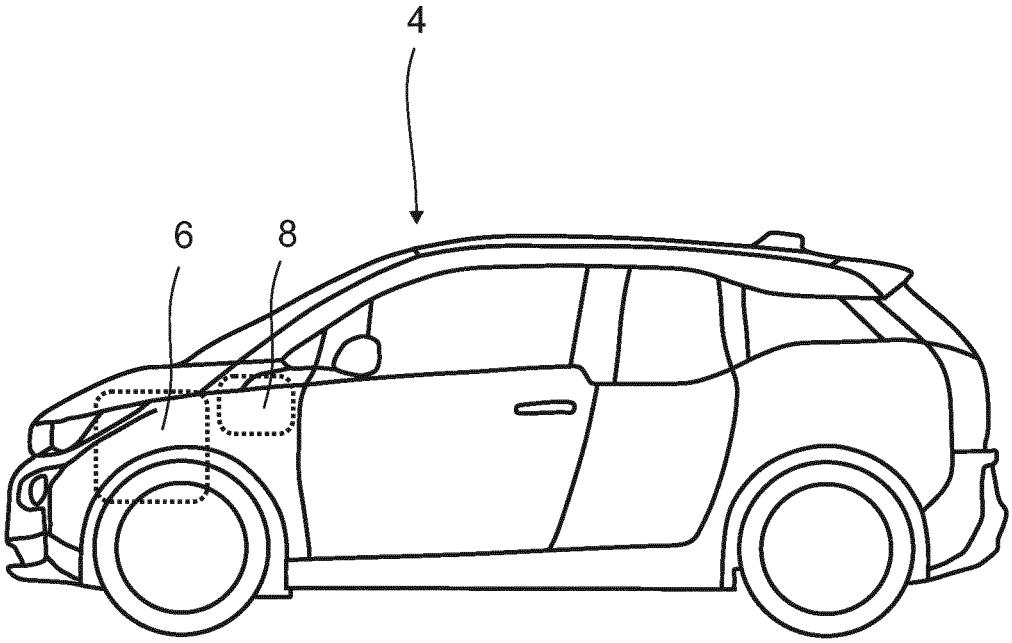
FIG. 1 shows, in a schematic view, a vehicle having an engine according to an embodiment of the invention.

FIG. 1 shows a vehicle 4 having an engine 6 according to the invention and a control system 8.

Figure 2:
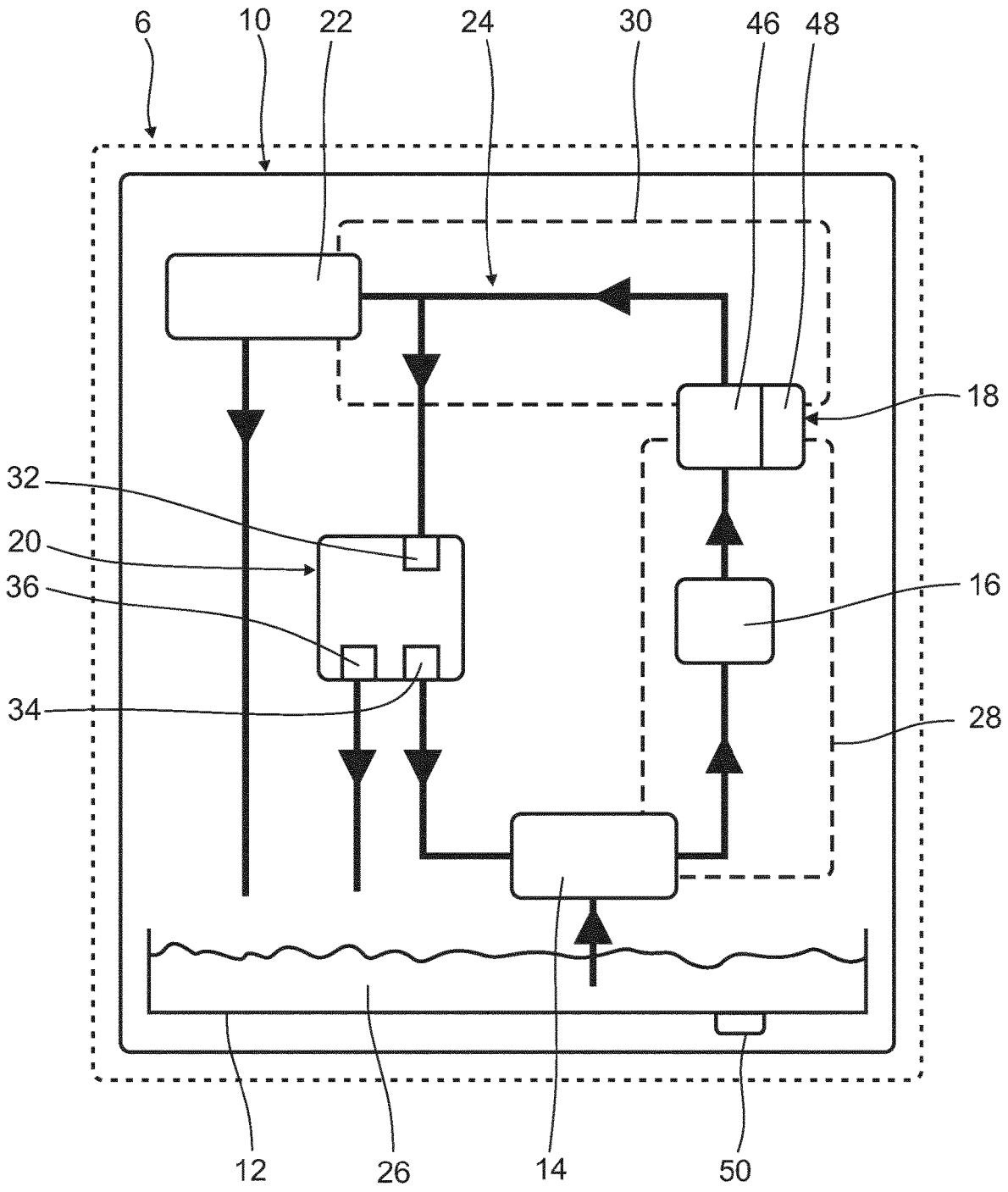
FIG. 2 shows, in a schematic view, the engine shown in FIG. 1 having an engine block according to an embodiment of the invention.

FIG. 2 schematically shows the structure of the engine 6. The engine 6 comprises an engine block 10 according to the invention comprising an oil pan 12, an oil pump 14, an oil cooler 16, an oil filter 18, a switching valve 20 and also a crankcase 22. Furthermore, FIG. 2 shows a schematic view of the engine oil circuit 24, which is provided for supplying the engine block 10 with engine oil 26.

The oil pump 14 sucks up the engine oil 26 from the oil pan 12 and pumps it by means of a raw oil feed line 28 to the oil filter 18, in which the engine oil 26 is processed. The engine oil 26 cleaned by the oil filter 18 is forwarded via the clean oil riser 30 to the crankcase 22, in which it is used for lubricating and cooling the engine block 10 and is then conducted back into the oil pan 12.

The switching valve 20 has a port 32 for the clean oil riser 30, by way of which the switching valve 20 is fluidically connected to the clean oil riser 30, a port 34 for the oil pump 14, by way of which the switching valve 20 is fluidically connected to the oil pump 14, and also a port 36 for the oil pan 12, by way of which the switching valve 20 is fluidically connected to the oil pan 12.

FIGS. 3A to 3D show the various positions of the switching valve 20, which here is a 3-way valve.

Figure 3A:
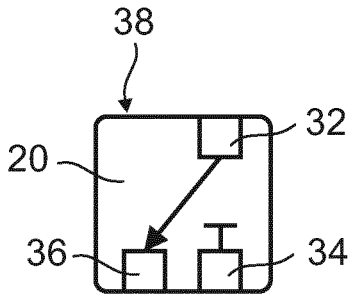
FIGS. 3A to 3D each show, in a schematic illustration, a position of the switching valve of the engine block shown in FIG. 2.

FIG. 3A shows the first position 38, in which a connection is established between the port 32 for the clean oil riser 30 and the port 36 for the oil pan 12. The port 34 for the oil pump 14 is closed. In said first position 38, the engine oil 26 present in the clean oil riser 30 is drained into the oil pan 12.

When the engine 6 is running, the first position 38 of the switching valve 20 is blocked by the control system 8, in order to prevent damage to the engine 6 on account of an undersupply of the crankcase 22 with engine oil 26.

Figure 3B:
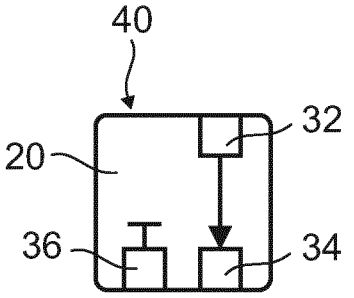

FIG. 3B shows the second position 40, in which a connection is established between the port 32 for the clean oil riser 30 and the port 34 for the oil pump 14. The port 36 for the oil pan 12 is closed. In said second position 40, the pressure of the clean oil riser 30 is passed on to the oil pump 14.

Figure 3C:
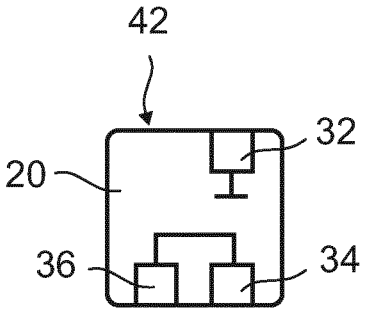

FIG. 3C shows the third position 42, in which a connection is established between the port 34 for the oil pump 14 and the port 36 for the oil pan 12. The port 32 for the clean oil riser 30 is closed. In said third position 42, the pressure in the oil pump 14 is reduced.

Figure 3D:
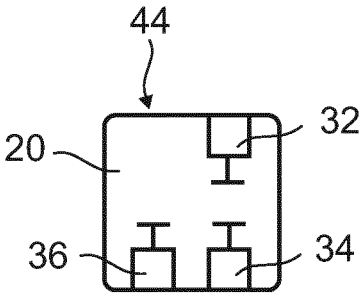

FIG. 3D shows the fourth position 44, in which all of the ports 32, 34, 36 are closed. In said fourth position 44, the pressure in the oil pump 14 is maintained.

The delivery capacity of the oil pump 14 can be regulated independently of the rotational speed of the engine 6 by way of controlling the pressure in the second, third and fourth position 40, 42, 44 of the switching valve 20.

For an engine oil service, the engine oil 26 in the engine 6 is drained and the filter device (not shown) in the oil filter 18 is changed or cleaned.

The oil filter 18 consists of an oil filter housing 46 and an oil filter cover 48 (see FIG. 1), which is removable for the purpose of changing or cleaning the filter device.

During the engine oil service, firstly the engine 6 is switched off. When the engine block 10 is stationary, the engine oil 26 flows out of the crankcase 22 into the oil pan 12, where it accumulates, since the oil pump 14 does not repump any further engine oil 26.

In this process, some of the engine oil 26 remains in the clean oil riser 30 on account of the geometry of the engine block 10 and gravity. In order to drain said engine oil 26 in the clean oil riser 30 into the oil pan 12, the switching valve 20 is then moved into the first position 38, and thus a connection from the clean oil riser 30 to the oil pan 12 is created, via which the engine oil 26 can flow out.

The venting of the clean oil riser 30 additionally has the advantage that the engine oil 26 in the raw oil feed line 28 can flow out more rapidly via the oil pump 14 into the oil pan 12, since no pressure which counteracts the flowing away of the engine oil 26 can thus build up in the raw oil feed line 28.

If the oil filter cover 48 is then removed from the oil filter housing 46 in order to clean the oil filter 18, essentially no engine oil 26 which can run out of the oil filter 18 when the latter is opened and can soil the surroundings of the engine block 10 is present there any longer.

The engine oil 26 which has flowed away into the oil pan 12 is drained from the engine 6 by opening a closure element 50 in the oil pan 12, such as for example a screw, and can then be disposed of in a professional manner.

The above-described structure and the mode of operation of the engine 6 and also of the engine block 10 is not limited to engines 6 and engine blocks 10 for vehicles 4, but instead can be provided for any desired engines 6 and engine blocks 10.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An engine block, comprising:
an oil pan;
an oil pump;
a clean oil riser; and
a switching valve,
wherein
the switching valve includes an oil pan port, an oil pump port, and a clean oil riser port,
the switching valve has a first position in which a connection is established between the clean oil riser port and the oil pan port, and
the switching valve has a second position in which a connection is established between the clean oil riser port and the oil pump port.

2. The engine block as claimed in claim 1, wherein
the switching valve is a 3-way valve.

3. The engine block as claimed in claim 1, wherein
the switching valve has a third position in which a connection is established between the oil pump port and the oil pan port.

4. The engine block as claimed in claim 3, wherein
the switching valve has a fourth position in which the clean oil riser port and the oil pump port are closed.

5. The engine block as claimed in claim 4, further comprising:
a control system configured to control the opening and closing of the switching valve ports in accordance with predetermined engine operating conditions.

6. The engine block as claimed in claim 1, further comprising:
a control system configured to control the opening and closing of the switching valve ports in accordance with predetermined engine operating conditions.

7. The engine as claimed in claim 5, wherein
the control system is configured such that the switching valve is switchable into the first position only when the engine is not being operated.

8. The engine as claimed in claim 6, wherein
the control system is configured such that the switching valve is switchable into the first position only when the engine is not being operated.

* * * * *